United States Patent [19]

Withers et al.

[11] 4,342,637

[45] Aug. 3, 1982

[54] COMPOSITE ANODE FOR THE ELECTROLYTIC DEPOSITION OF ALUMINUM

[75] Inventors: James C. Withers, Strongsville; Gary V. Upperman, North Olmsted, both of Ohio

[73] Assignee: Metallurgical, Inc., Lakewood, Ohio

[21] Appl. No.: 118,972

[22] Filed: Feb. 6, 1980

Related U.S. Application Data

[63] Continuation-in-part of Ser. No. 62,135, Jul. 30, 1979, and Ser. No. 52,578, Jun. 27, 1979, abandoned, which is a continuation-in-part of Ser. No. 944,987, Sep. 22, 1978, abandoned.

[51] Int. Cl.[3] ..... C25C 3/06; C25C 3/12; C25C 3/16; C25C 3/24

[52] U.S. Cl. ..... 204/282; 204/243 R; 204/244; 204/245; 204/283; 204/290 R; 204/291; 204/294

[58] Field of Search ..... 204/67, 243 M, 294, 204/243 R, 297 R

[56] References Cited

U.S. PATENT DOCUMENTS

| | | | |
|---|---|---|---|
| 400,766 | 4/1889 | Hall | 204/67 |
| 503,929 | 8/1893 | Hall | 204/67 |
| 2,822,328 | 2/1958 | Walker | 204/247 |
| 2,958,641 | 11/1960 | Reynolds | 204/286 |
| 2,979,449 | 4/1961 | Sheer et al. | 204/164 |
| 3,028,324 | 4/1962 | Ransley | 204/67 |
| 3,322,658 | 5/1967 | Sem | 204/243 R |
| 3,438,876 | 4/1969 | Marshall, Jr. | 204/67 |
| 3,909,375 | 9/1975 | Holliday et al. | 204/67 |
| 3,919,058 | 11/1975 | Waenerlund | 204/67 |
| 4,076,610 | 2/1978 | Bizzarri | 204/290 R |
| 4,135,994 | 1/1979 | Ishikawa et al. | 204/67 |

FOREIGN PATENT DOCUMENTS

| | | | |
|---|---|---|---|
| 802995 | 12/1968 | Canada | 204/67 |
| 2805374 | 8/1979 | Fed. Rep. of Germany . | |
| 4087 | of 1879 | United Kingdom | 204/67 |
| 2888 | of 1883 | United Kingdom | 204/67 |
| 16794 | of 1889 | United Kingdom | 204/67 |
| 483068 | 7/1936 | United Kingdom . | |
| 511076 | 3/1938 | United Kingdom . | |
| 1177829 | 1/1970 | United Kingdom . | |

OTHER PUBLICATIONS

A. Minet, "The Production of Aluminum and Its Industrial Use", p. 253, John Wiley & Sons, 1905.

*Primary Examiner*—Howard S. Williams
*Attorney, Agent, or Firm*—Laurence R. Brown

[57] ABSTRACT

An anode is provided for use in the electrolytic deposition of aluminum at low temperatures in which the anode is the sole source of aluminum and comprises a composite mixture of an aluminous material such as aluminum oxide and a reducing agent such as carbon. Conductor means of higher electrical conductivity than the anodic mixture are provided to conduct substantially the entire anodic current to the active anode surface thereby reducing the voltage drop through the highly resistive composite mixture. The conductors may be of aluminum and sized to melt back at substantially the same rate at which the mixture is consumed. The mixture may be employed in a self-baking mode or be pre-baked. Alternatively, the mixture may be in a particulate form and contained within a porous membrane which passes the electrolyte or other dissolved material while withholding undissolved impurities. The membrane may be used with a conductor to provide bipolar electrode faces.

23 Claims, 15 Drawing Figures

COMPOSITE ANODE FOR THE ELECTROLYTIC DEPOSITION OF ALUMINUM

This invention is a continuation-in-part of copending applications Ser. No. 052,578 filed June 27, 1979, which is a continuation-in-part of Ser. No. 944,987 filed Sept. 22, 1978, both now abandoned, and Ser. No. 062,135 filed July 30, 1979.

Certain aspects of the cell arrangements and processes disclosed herein are the subject of co-pending applications by the same inventors.

FIELD OF THE INVENTION

This invention relates to the electrolytic production of aluminum from aluminous materials using an electrolyte bath containing halides; more particularly, the present invention relates to the electrodeposition of aluminum using an anode as the sole source of aluminum in an electrolytic cell maintaining dimensionally stable spacing between cathode and anode at low bath temperatures to effect great energy savings.

BACKGROUND OF THE INVENTION

The commercial production of the aluminum in the world has been by the Hall-Heroult process. In this well-known process a purified source of alumina is dissolved in a molten primarily fluoride salt solvent, consisting essentially of cryolite and then reduced electrolytically with a carbon anode according to the reactions $$\tfrac{1}{2}Al_2O_3+\tfrac{3}{4}C+3e\rightarrow Al+\tfrac{3}{4}CO_2$$

and $$\tfrac{1}{2}Al_2O_3+3/2C+3e\rightarrow Al+3/2CO.$$

Three characteristics of this system which are inherent in the Hall-Heroult process include: first, carbon dioxide is produced and the carbon anode is consumed at the rate of 0.33 to 1 pound of carbon per pound of aluminum produced which results in a required continual movement of the carbon anode downwardly toward the cathode aluminum pool at the bottom of the cell to maintain constant spacing for uniform aluminum production and thermal balance in the cell; second, the need to feed intermittently and evenly the solid alumina in a limited concentration range to the "open type" cell to maintain peak efficiency of operation in order to avoid "anode effects"; third, severe corrosion of cell materials due to the high temperatures of 950°-1000° C. and the fluoride salts resulting in relatively low cell life and increased labor.

A fourth characteristic not inherent in the system but present nonetheless is that the cell power efficiency is limited to less than about 50% due to the practical requirement of maintaining a carbon anode to liquid aluminum distance greater than one inch to reduce the magnetic fields' undulation of the aluminum layer causing intermittent shorting with resultant Faradaic losses due to the back reaction of aluminum droplets with carbon dioxide, $$Al+3/2CO_2\rightarrow\tfrac{1}{2}Al_2O_3+3/2CO.$$

The first three inherent limitations of the conventional Hall-Heroult process can potentially be overcome either by use of an aluminum chloride electrolysis process which in the prior art would directly produce aluminum and chlorine gas or through the use of all fluoride bath at temperatures of 670°-750° C. for the direct reduction of aluminum oxide.

The potential advantages of an aluminum chloride salt electrolysis process include: (1) the use of chloride salts which are generally more economical than the fluorides of the Hall-Heroult salts, have a lower operating temperature of 670°-800° C., are much less corrosive to cell construction materials and have in general a lower specific gravity which can permit closer anode-cathode spacing; (2) the aluminum chloride electrolysis process requires a closed system reducing air pollution problems; (3) the chloride electrolytes, even at the lower operating temperature of 670°-800° C., have higher conductivities than that of the Hall-Heroult fluoride salts at 950°-1000° C. This results in the production of aluminum at lower energy consumption and at higher power and current efficiencies; (4) the use of the aluminum chloride electrolysis process has a very broad operating range of aluminum concentration which results in no "anode effect"; (5) it is possible to design the aluminum chloride electrolytic process cell with bipolar electrodes which result in a much more compact cell with increased production potential per unit volume.

There are, however, potential advantages to the use of an all fluoride bath if it is possible to use the Hall-Heroult reaction mechanism system and yet continue to deposit metal. The all fluoride bath potentially: (1) avoids substantial structural changes in the cell if the aluminum oxide can be directly reacted thereby making unnecessary the requirement of the chloride system to close the top of the cell and (2) does not evolve any corrosive, noxious anode gas, merely $CO_2$. To achieve these advantages the all fluoride bath must be used at low temperatures of 670°-800° C. but such is not possible in accordance with prior art techniques because alumina, unlike aluminum chloride, will not readily dissolve at such low temperatures.

In the comparison of the commonly used Hall-Heroult alumina-fluoride process and the much less familiar aluminum chloride process, there appear to be significant benefits in the use of the aluminum chloride process, but a fair comparison should not overlook the significant disadvantage of the aluminum chloride electrolytic process in producing large quantities of the corrosive gas chlorine liberated at the anode. The chlorine entrains the chloride electrolyte to clog the exit ports and deplete the bath. This entrained electrolyte must be collected and returned to the cell and the liberated chlorine must be recycled to produce further aluminum chloride.

Although the potential advantages of utilizing an aluminum chloride electrolysis process for the electrolytic production of aluminum have been recognized for well over a century, commercial realization of such a process has not occurred.

In general, the usual process known to the prior art for producing aluminum chloride has been the conversion of an alumina-containing material with chlorine in the presence of carbon to yield aluminum chloride and a mixture of the gases carbon dioxide and carbon monoxide. This reaction, $$Al_2O_3+C+Cl_2\rightarrow AlCl_3+CO_2 \text{ and } CO$$

has been carried out under a wide range of conditions, each variation having some alleged advantage. All of these procedures for producing aluminum chloride have a common thread however. Each involves the use of a source of carbon, a source of chlorine, and an aluminum chloride reactor separate from the electrolytic cell in which the metallic aluminum is electrolytically produced.

The normal reaction temperature for the production of aluminum chloride is generally in the range of 400° C. to 1000° C. depending upon the form of the reacting agents. Unless a high purity alumina source is used, other elements that are generally present such as iron, silicon, and titanium, are also chlorinated and must undergo difficult separation from the aluminum chloride. This contributes to the size and cost of the aluminum chloride producing plants.

The aluminum chloride electrolytic process would have an unusual advantage beyond those advantages heretofore cited if it were possible to avoid both the chlorine collection and the independent production of aluminum chloride in a plant separate from the electrolysis plant.

The electrodeposition of aluminum by the direct reduction of alumina in an all fluoride bath is an attractive alternative to the aluminum chloride system provided that the alumina would dissolve at the low temperatures of 670°-800° C. rather than the 950°-1000° C. considered to be required for dissolution in molten cryolite. Existing Hall-Heroult cells could be used without substantial capital expenditures and great energy savings would be possible with such an all fluoride bath but no such process for the electrodeposition of aluminum is available to those skilled in the art.

The fourth disadvantage of the Hall-Heroult cell, cell power efficiency, has been considered by those skilled in the art but it appears that the practical limit to energy saving and efficiency in present Hall-Heroult cells has been reached through careful design and operation of 150 to 225 Kamp cells at anode current densities between 4.0 and 5.5 amps/in$^2$. The lower energy limit appears to be about 5.6 to 6.0 Kwh/lb utilizing the most advanced currently known designs, computer controls, bath modification and other improvements.

Lower temperatures are not possible in the Hall cell due to the lack of solubility of aluminum oxide in the cryolite at temperatures below about 940° C. and the fact that cryolite base salts have a freezing point in the range of 925°-950° C. The lack of dissolved $Al_2O_3$ present in the bath would result in an anode effect which would at least increase the required voltage by 10-20 fold and cease aluminum deposition. If a low temperature operation of such a cell would have been possible, non-cryolite salts would permit both the use of non-aggressive salt compositions and reduced temperature gradients that would result in little or no dimensional change in the cell walls and bottoms and consequently minimize the spacing changes between the anode and cathode.

SUMMARY OF THE INVENTION

A composition is provided for use as an anode in the low temperature electrodeposition of aluminum comprising an aluminous source such as $Al_2O_3$ and a reducing agent such as carbon in compound or element form.

The greatly increased electrical resistance of such mixture is minimized by passing the anodic current through one or more conductors of low electrical resistivity which extend through the mixture to or approximately to the active reaction face of the mixture in the electrolyte. The position of the end[s] of said conductor[s] is maintained relative to the reaction face as the mixture is consumed in the electrolysis. Conductors of graphite will not be consumed in the reaction as the necessary reducing agent is provided by the carbon in the mixture so that such graphite conductor[s] may be employed with an aluminum oxide-carbon mixture in particulate form held in anodic contact with the conductor[s] by being contained within a porous membrane passing electrolyte or other dissolved material while withholding undissolved oxides or impurities. Such particulate mixture is replenished as it is consumed in the reaction.

Mixtures of oxide and carbon bonded into an integral body are preferably employed with conductor[s] of aluminum positioned as described with respect to the graphite conductor[s] but sized and spaced so as to have the conductor[s] melt back from the reaction face at a rate substantially corresponding to the rate at which the bonded mixture is consumed in the electrolytic reaction. Thus in this embodiment the position of the end of the conductor relative to the reaction face of the anode is also substantially constant.

These arrangements provide a minimal length of current path through the high resistant mixture of the aluminum oxide and carbon, and thus result in a low voltage drop of the anodic current in its passage to the reaction face.

The electrolytic production of aluminum using the anode may be accomplished in a single cell from a molten halide salt bath containing aluminum and chloride ions which is not depleted due to electrolysis and wherein aluminum ions are reproduced in situ from the anode within the electrolytic cell. Aluminum ions are produced at the anode by the reaction of the aluminous source and a reducing agent serving as the anode. The aluminum ions are then deposited as aluminum metal at the cathode.

Aluminum also may be deposited by the direct electrolytic reduction of a dissociated and/or dissolved aluminum oxide to produce molten metal at a temperature as low as 670°-810° C. with the use of an all fluoride containing bath and an anode containing aluminum oxide and reducing agent.

THE DRAWINGS

DETAILED DESCRIPTION OF THE INVENTION

The Electrolytic Cells

The electrolytic system of the present invention utilizes an electrolytic cell C, with an electrolytic bath B depicted in any one of the Figures for the unique continuous production of aluminum.

Figure 1:
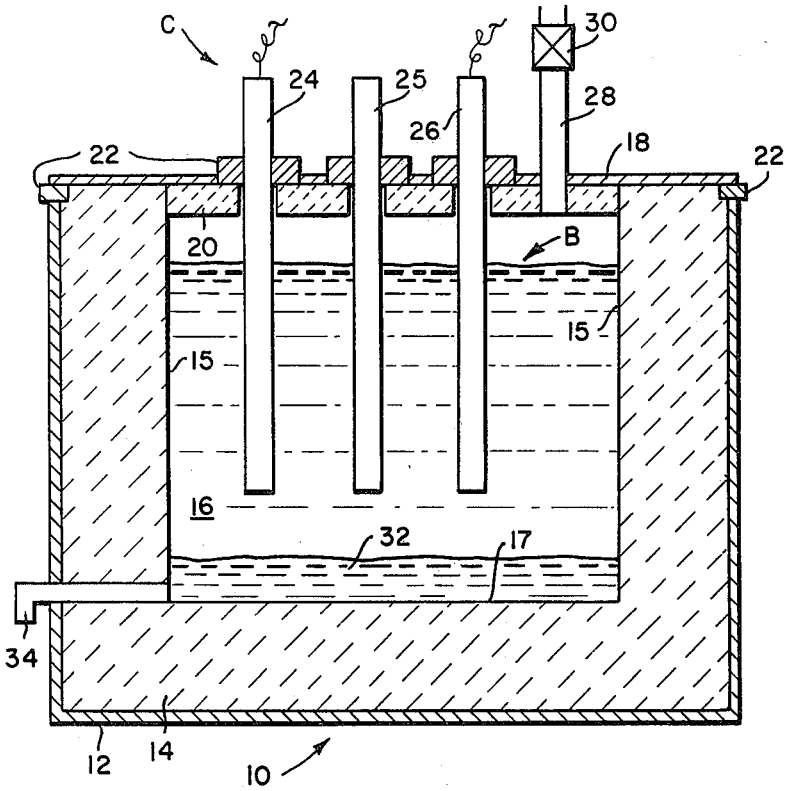
FIG. 1 is a schematic showing in cross section of the electrolytic cell of the present invention containing a chloride bath and illustrating the closed top of the cell along with the relative positioning of the electrodes.

FIG. 1 schematically shows one form of the electrolytic cell structure generally at 10 as composed of an outer steel shell having a refractory lining 14 that may serve solely as a thermal insulator or as both insulator and electrode. The refractory lining may be of any material resistant to the action of the molten electrolytic bath 16. The refractory lining having conventional vertical sides 15 and bottom 17 is designed to maintain the desired thermal balance in the cell operation and therefore may be very thin in cross section in order to achieve a small thermal gradient resulting in both a thin layer of frozen salt on the surface of the refractory and a hot outer wall on the surface of the steel shell 12. The refractory lining may also be quite thick to achieve a freeze-out layer of salt within the refractory lining resulting in a cool surface on the steel shell although this is not necessary in the vertical sided cell of FIGS. 1–6. In contrast, in the slope sided electrode cell of FIG. 7 cathode 19 is a conductive lining formed on both sides of the anode. A thermal and electrical insulation lining may be positioned between the cathode 19 and the shell 12 if desired. The freeze line should be within the boundaries of this conductive lining or cathode 19 in order to prevent a solid layer of salt collecting on the bath side of the electrodes. Such a salt layer would act as an electrical insulator and prevent effective current flow.

The lid 18 is provided on the top of the cell to produce an air-tight closure and is only necessary in a chloride containing bath. This lid thus prevents air and moisture from seeping inside the cell or any vapors of the salt composition 16 from leaking out to react with the environment. The lid 18 may be lined with the refractory material 20 which may be the same as the refractory lining 14 or any other refractory material consistent with maintaining a temperature balance in the cell as well as being chemically inert to the salt composition 16. Seals 22 are supported on the lid 18 and are secured against the electrodes 24, 25 and 26 to prevent atmospheric air and moisture from seeping into the cell or the vapors from the cell exiting to the environment. The sealing at the lid 18 and around the electrodes may be by any means which prevents vapor leaks and may be standard or conventional packing and gasket material capable of withstanding the temperature of the operation while being resistant to the electrolyte vapors. Acceptable materials for such packing gasket use include asbestos, fibrous ceramics, Teflon, Vitron, silicons, liquid metal seals such as mercury, liquid solder, tin, lead, etc.

Electrodes 24, 25 and 26 may be anodes, cathodes or bipolar electrodes, as shown in detail in FIGS. 2, 2A, 2B, 5 and 6. They may include solid or coated conductors to carry electric current for the cell operation. These conductors may be any material that will withstand the temperature within the cell, be stable to the halide composition 16 and is a good electrical conductor. Materials that are useful for this purpose are carbon, graphite, and titanium carbides, nitrides or borides and aluminum metal as appropriately sized for heat transfer balance. The preferred materials for these conductors have been found to be graphite and titanium diboride when operating in the bipolar mode.

Electrolysis could be conducted at temperatures ranging from 150° to 1060° C. but most preferably the temperature employed exceeds the melting point of aluminum, so as to produce aluminum in molten form, and does not exceed 810° C., as higher temperatures involve the unnecessary expenditure of energy and produce a more aggressive electrolyte.

The aluminum chloride cycle cell also includes a stack or exit tube 28 having a valve 30 to control the flow of any gaseous elements from the stack and establish the pressure buildup in the cell for continuous operation. Gaseous vapors emanating from the cell are those of the oxidized reducing agent and notably there is no chlorine gas detected at all from an aluminum chloride containing salt. If any chlorine would be produced it would react at the anode 26 and be recycled as aluminum chloride. The molten aluminum 32 is tapped out by conventional tap 34 or otherwise drawn out by vacuum through standard siphoning techniques well known in the art.

Figure 3:
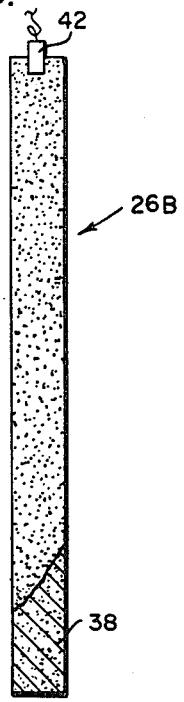
FIG. 3 is a schematic illustration partly broken away of another alternative electrode.
Figure 4:
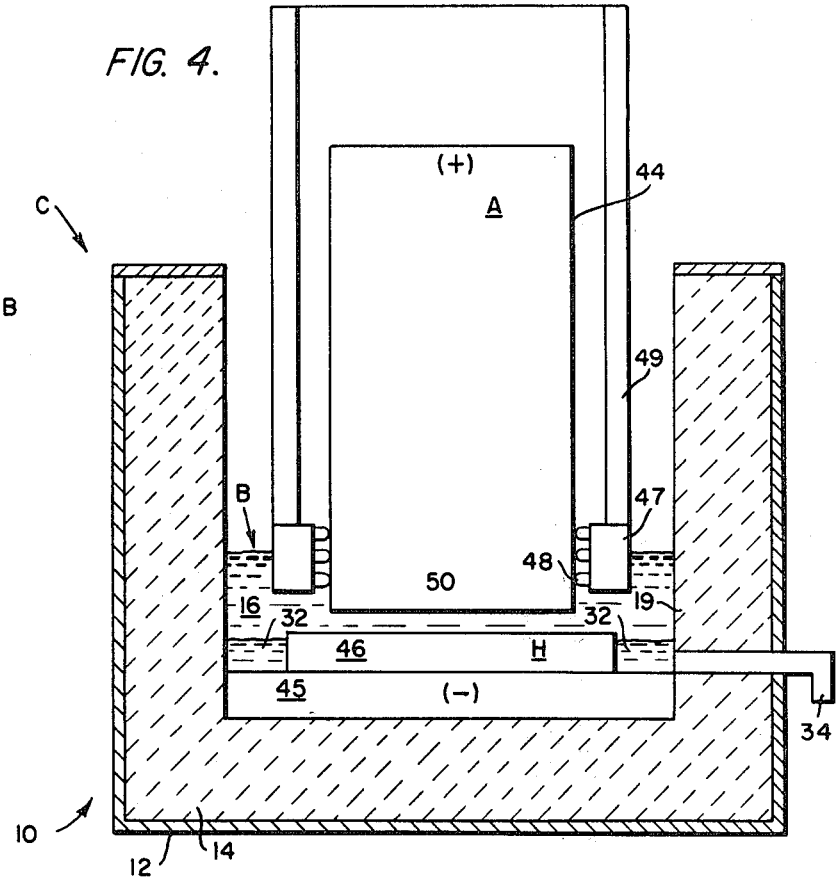
FIG. 4 is a schematic illustration in cross section of an open top electrolytic cell having an all fluoride bath and an anode clamp providing a source of electric current to a continuously introduced anode.

FIG. 4 illustrates a modification of the cell design of FIG. 1 again illustrating vertical sided electrodes 19. The cell structure, including the shell 12 and refractory 14, are the same as that previously described, the electrode 44 serving as the anode may be either one of the anodes shown in FIGS. 2, 2A or 2B but preferably FIG. 3. The anode 44 is immersed in the electrolyte containing fluoride or chloride salts or mixtures thereof and heated to a temperature generally between 670° and 810° C. At the bottom of the cell, and resting upon cathode bar 45 positioned over the refractory insulation 14 is a block 46 which preferably is slightly wider than the anode 44 and serves as the cathode through suitable electrical connection to cathode bar 45. The block 46 may be made from any of the previously described electrode materials. The block 46 should extend close to the base 50 of the anode 44 which is the only surface for erosion of the anode. Closer anode-cathode spacing for such electrode configuration is possible when the block 46 also rises above the level of the molten aluminum 32. As the aluminum is deposited on the cathode block 46, its surface is wetted and the aluminum runs off the block into the pool 32 at the bottom of the cell to be tapped off as desired at 34.

Figure 12:
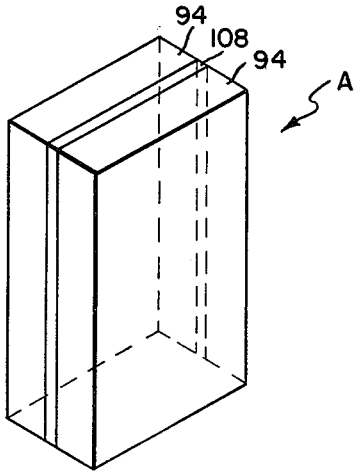
FIG. 12 is a schematic perspective view of a further embodiment of the composite anode of the present invention illustrating a laminar construction.
Figure 13:
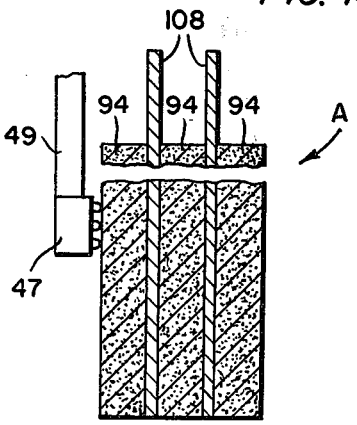
FIG. 13 is also a schematic perspective view of the anode of FIG. 12 and the anode clamp of FIG. 4.

FIG. 4 also illustrates a power attachment clamp 47, shown schematically, in contact with the anode 44 either above but preferably below bath level and adjacent to the bottom of the anode to minimize the power loss due to the resistance of the anode. Anode 44 may be structured for instance as shown in FIGS. 3, 12 and 13. The clamp does not act as an anode because the composite anode preferentially decomposes in the bath. The clamp 47 may partially or completely surround the anode 44 as it may be fed continuously into the bath. The clamp is composed of any suitable inert material that is electrically conductive. Among these materials are graphite, carbon, $TiB_2$ or mixtures of these. The electrical contact between the clamp and the anode may be through protruding contact point or nub 48. The power attachment to the clamp 47 is through suitable split cylindrical conductors 49 that extend above the cell top.

Figure 5:
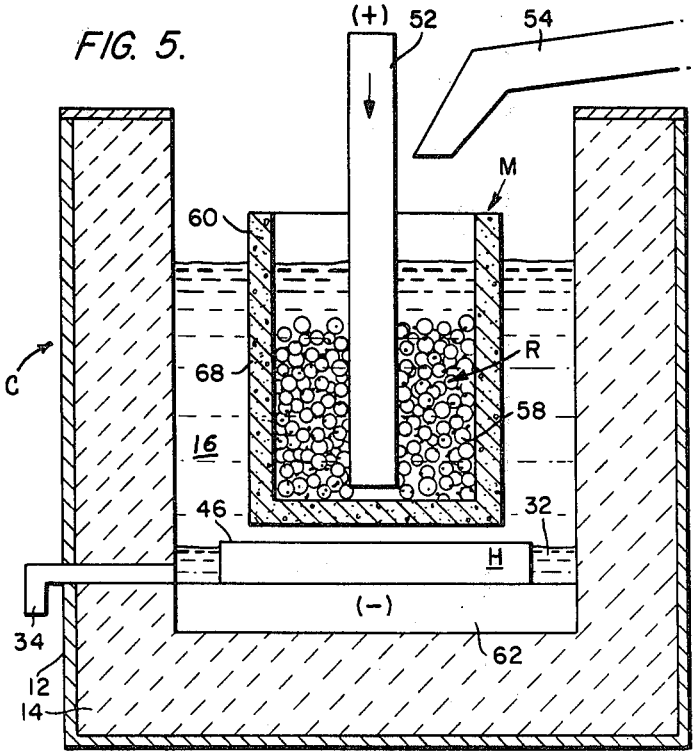
FIG. 5 is a schematic view of an embodiment of the present invention which illustrates the use of a porous membrane to contain the various anodic materials including an aluminum containing material and a reducing agent.
Figure 3:
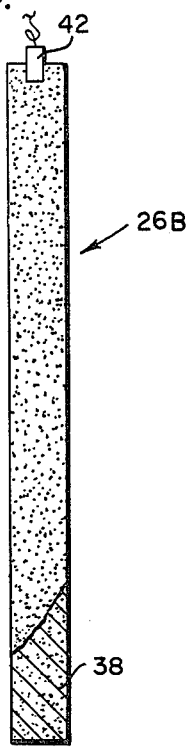
Figure 4:
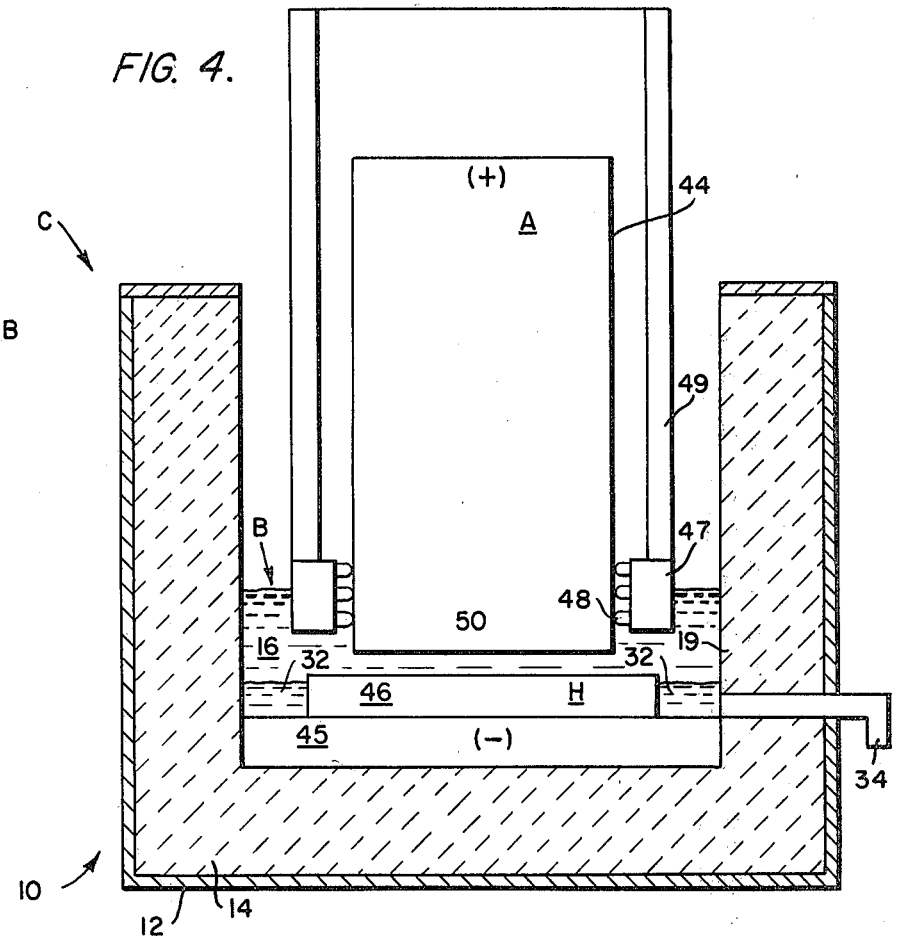
Figure 4A:
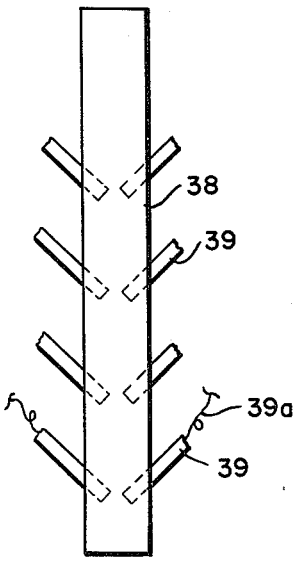
Figure 5:
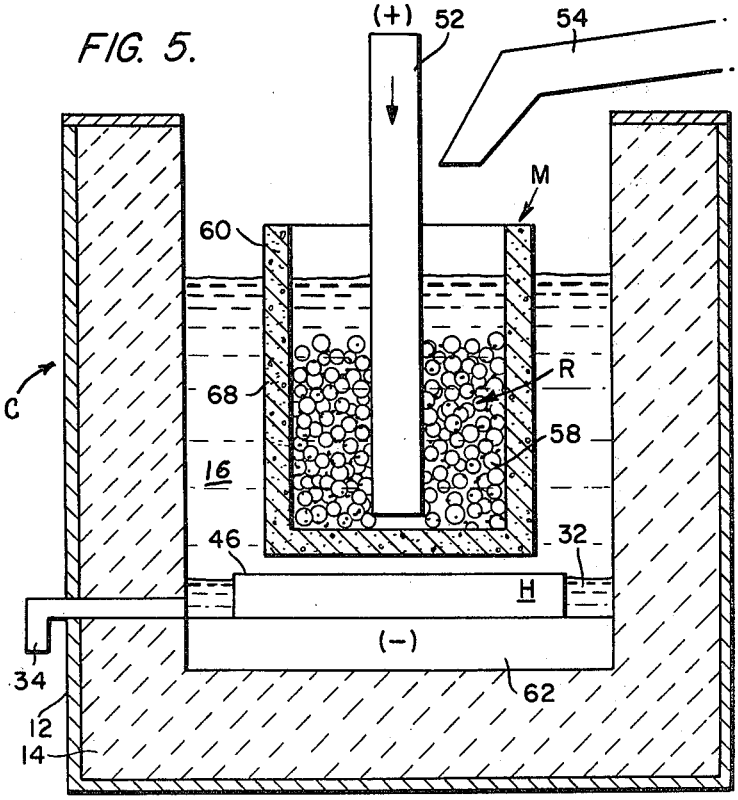

In lieu of changing the anodes periodically to supply fresh aluminous material, the present invention is adaptable to a feed mechanism for continuous operation as shown in FIG. 5 or the continuous feed of an electrode as shown in FIG. 4 of the prebaked or Soderberg type.

Protruding up through the cell C of FIG. 5 is an anode electrode 52 which penetrates deeply into the melt 16 but remains above the molten aluminum pool of aluminum 32 or the cathode block 46. Surrounding the anode 52 are the anode raw materials, shown generally at R, comprising the aluminous material and the reducing agent. This anodic mixture may be formed into small particle size from a 0.001 inch approximately to 1.0 inch or more and may have been formed by extrusion, molding or the like and fed into the cell by the hopper 54. The raw material particles of aluminous material and reducing agent are identified specifically at 58 and are in close contact with the anode 52 to provide the necessary source of aluminum and the reducing agent.

These anodic raw materials are held in close contact with each other and with the anode 52 by being contained in a porous membrane container 60 which surrounds the anode 52. As the anode materials 58 are used up and their level drops substantially below the level of the molten bath 16, feed 54 is operated to add additional anodic materials 58 into the porous membrane container 60.

Figure 6:
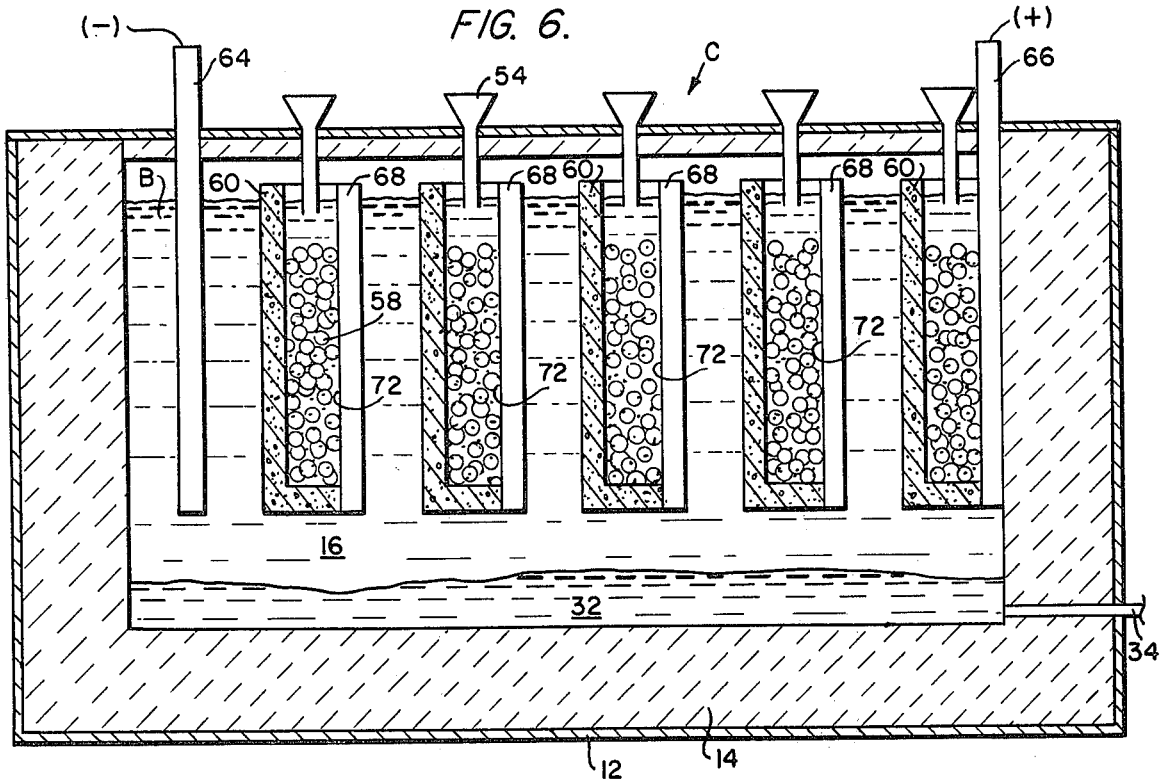
FIG. 6 is a schematic view in cross section of another alternate embodiment of an electrolytic cell illustrating the use of bipolar electrodes.

In the embodiment of FIG. 6 there is illustrated a bipolar cell. Again, like structure has been designated with the same identifying numerals.

The same basic principle in operation of the bipolar cell exists except that there is a pair of electrodes at either end of the cell which are connected to a suitable electric source. One of the electrodes 64 is a cathode and at the opposite end an anode 66. Between the electrodes 64 and 66 is a group of spaced electrodes 68 which are unconnected to each other or to any electrical source. Secured to each of the electrodes 68 and the anode 66 is a porous membrane container 60 of the same type as that described at 60 in FIG. 5. The porous membrane 60, however, in the bipolar cell has as one side, one of the electrodes 66 or 68 that form the enclosure for the anodic raw materials 58.

In the bipolar cell the side of the electrode 68 nearest the anode 66 becomes negatively charged and the side of the electrode 68 facing the cathode 64 become positively charged. This side 72 of the electrode 68 will act as the anode and is the side that is in contact with the anodic raw materials 58. The electrolysis then produces aluminum on the negative side of the electrode 68 and $CO_2$ on the positive or anodic side of the same electrodes. The aluminum falls to the pool 32 at the bottom to be collected in the usual manner.

In FIGS. 7 through 11 there is illustrated the sloping sided electrode-electrolytic cell which in combination with the anode composition of the present invention results in substantial economies in the electrodeposition of aluminum.

In typical Hall cell procedures aluminum reduction cells have an anode-cathode spacing which must take into consideration the magnetic field effect and the "back reaction" due to the undulations of the aluminum pool. Such considerations prevent any closer spacing than about 1.5 and 2.0 inches between the bottom surface of the anode where all erosion occurs and the top of the aluminum pool or the cathode electrode. A further and equally significant reason for the requirement of greater spacing between the cathode and anode whether in the Hall cell construction using vertical sides or any attempt to use a sloping side electrode is the serious difficulty of maintaining dimensional stability due to the high temperature required and the aggressive salts that necessarily were included to retain a high temperature for the dissolution of the alumina. In the combination of the slope sided electrode cells and the anode utilizing aluminum oxide and a reducing agent to provide the sole source of aluminum the use of temperatures as low as just above the melting temperature of aluminum minimizes any of the problems regarding dimensional instability and therefore enable the cells of the present invention to be structured with a closer anode-cathode spacing unattainable in the past. Thus it is the particular combination of the anode and the sloped walls for the construction of the cell that achieves a lower IR power drop in the salt due to the close spacing permissible between the sloped walls and the reduction in the anode current density.

Essentially the cells of FIGS. 7 through 11 are similar to those previously described except for the sloping surfaces forming the electrodes. With this cell structure the anode 74 is provided with sloping sides 76 which as shown are external and directed downwardly and inwardly although the direction of the angle is not at all critical. The slope of the sides may be in any direction or any angle from the level of the bath B. The angle may even vary from 10° to 80° or more from the bath level. Through the use of the sloping sided electrode's anode bottom and that portion of the sloping anode side that is immersed in the bath 16, the anode will erode over a greater surface area and supply the aluminum for ultimate deposit on the cathode.

The cathode 78 has surfaces 79 of complementary shape to the sloping sides 76 of the anode to provide for an electrode spacing on the sides as shown by the spacing Y. This spacing may be between 0.25 and 2.5 inches. Greater spacing produces greater energy consumption. The spacing between the bottom 80 of the anode 74 in FIG. 7 and the surface of the aluminum layer 82 forming a part of the aluminum pool 84 is shown at X and may be 0.25 to 2.5 inches. Preferably the spacings X and Y should be between about 0.25 to 1.0 inches.

The spacing between the anode and the cathode above the solidified bath layer 86 is not significant to the utility of the invention. However the spacings X and Y between the anode and the cathode may be equal or different depending upon the desired current density and anode erosion but when set as close as specified above will result in substantial energy consumption savings.

The lining 78 forming the cathode of the cell may be of typical material used for electrolytic cells such as carbon, titanium diboride, or the like and is shaped as previously stated to conform to the external shaping of the anode 74. Additionally, the base of the lining has an inclined floor 90 for the aluminum pool leading into a catch well 92 for the aluminum. As can be seen the sloping floor 90 is such as to retain only a limited depth of aluminum layer which can be regulated through draw-off means (not shown) of the aluminum from the catch well. The purpose of the thin aluminum layer below the base 80 of the anode is substantially to eliminate the ripple or wave like undulations of the molten aluminum layer due to the magnetic effects within the cell.

Figure 7:
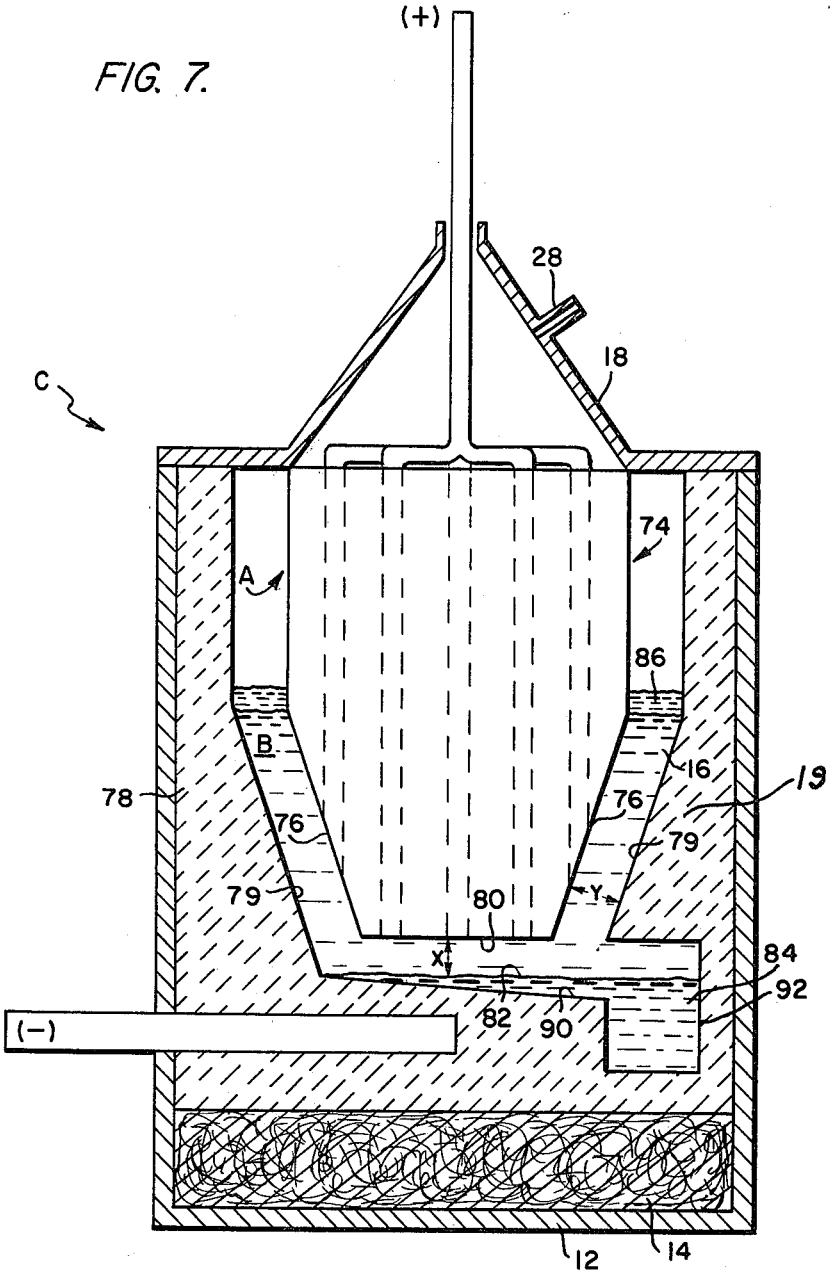
FIG. 7 is a schematic cross sectional view of a combination of electrolytic cells with sloped sided electrodes and the composite anode of complementary shape.

In other respects the cell of FIG. 7 is like that of FIG. 1 in that a lid 18 is provided with an exhaust port 28 being part of shell 12. Refractory insulation of any suitable form as shown at 14 may also be included.

The combination of the use of the anode of the present invention with sloped sides to conform to the sloped cathodes enables the configurations of the cell and anode to vary substantially as shown in FIGS. 8 through 11.

Figure 8:
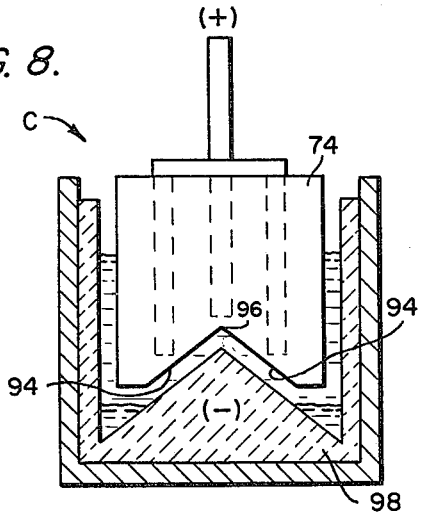
FIG. 8 is a schematic cross sectional view of a modification of the unique combination electrolytic cell and composite anode.
Figure 9:
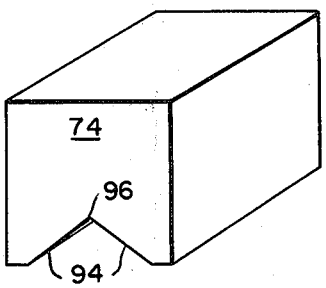
FIG. 9 is a perspective illustration of the anode of FIG. 8.

In FIGS. 8 and 9 the shape of the anode 74 is varied and has centrally located divergently sloped sides 94 which form an apex 96 in the anode. The carbon or other lining material such as $TiB_2$, etc. serving as the cathode projects upwardly to complement the internal shaping of the anode as best shown in FIG. 8. The operation of such a cell as shown in FIGS. 8 and 9 is essentially the same as that described in FIG. 7 particularly with regard to the increased erosion surfaces 94.

Figure 10:
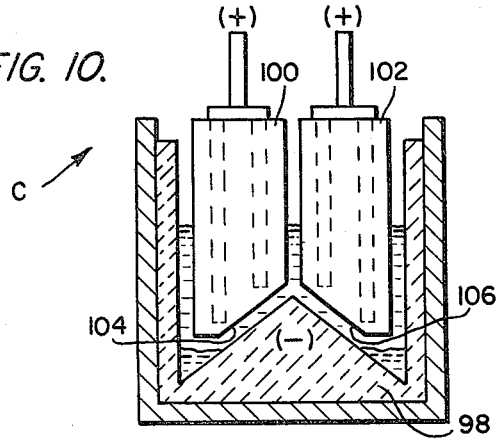
FIG. 10 is a schematic cross sectional view of another embodiment of the combination of FIG. 8.
Figure 11:
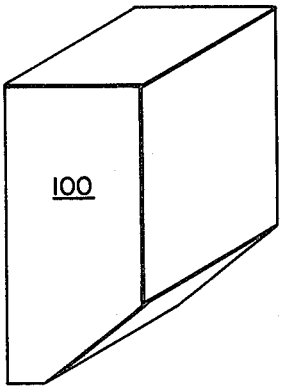
FIG. 11 is a perspective illustration of the anode of FIG. 10.

In FIGS. 10 and 11 dual anodes 100 and 102 with oppositely shaped sloped sides 104 and 106 respectively are positioned in a cell with cathode 98 shaped essentially identically to that described in FIG. 8.

The use of the sloped cathode concept of electrolytic cells shown in FIGS. 7 through 11 has been found to require that no frozen salt layer be permitted on the surfaces of the sloped cathode wall immersed in the bath and confronted with a portion of the anode surface. Otherwise the desired spacing between cathode and anode cannot be maintained. Additionally, the frozen salt that would adhere to the wall of the cathode is a good electric insulator and thus would inhibit current flow from the anode to the sloped cathode side wall. In prior use of such sloped walled electrodes the problem of salts freezing on the sides as well as dimensional instability of the lining prevented any extensive use of such cells. However with the anode composition of the present invention and the lower bath temperatures a variety of low melting salt compositions which will not freeze out on the side wall can readily be utilized. Ideally the melting point of the salt and the cell thermal balance is adjusted such that the freeze line of the salt is within the lining or at the steel shell rather than at the lining or cathode-bath interface. It is not important where the freeze line is located so long as the freeze line is within the lining and that the salt is maintained in a liquid state on the surface of the cathode lining immersed in the bath. In such instance the proper cathode-anode spacing is maintained without difficulty.

The Process a. Chloride Containing Bath

The electrolytic process of the present invention for the unique continuous production of aluminum ions at the anode utilizes the closed top electrolytic cell depicted in FIG. 1 or any of the other cells disclosed herein, if the top is closed or adequate provision is made to prevent: (a) moisture from contacting the chloride electrolyte, or (b) oxidation of the aluminum chloride, while containing the vaporized bath salts. The benefits of the present invention in using the chloride containing bath are derived not only from the continuous in situ production of aluminum ions at the anode but also from the use of a substantially lower energy requirement to produce a high quality aluminum with the total absence of chlorine gas exiting from the cell.

The continuous production of aluminum ion at the anode is brought about through the formation of the anode from an aluminous material containing aluminum oxide and a reducing agent. This anode is immersed in a molten bath containing alkali metal and/or alkaline earth metal halide salts of any composition provided that aluminum chloride is present in the bath. Upon electrolysis, ionized aluminum in the bath is deposited as aluminum metal on the cathode while the reaction at the anode also forms $CO_2$ in addition to the aluminum ion. The aluminum is collected as molten aluminum and drawn off but it is the reaction at the anode to reform aluminum ions that constitutes an important part of the present invention.

It is possible the halogen chlorine, whether it is the chloride ion, atomic chlorine or chlorine gas, may take part in the chloride reaction with the aluminum oxide of the aluminous material and the reducing agent of the anode to produce aluminum ions plus the reducing agent oxide. Aluminum from the anode is ionized in the molten bath for continuation of the cycle and the anions which may be chloride, oxide or other, maintain the charge balance with the aluminum ions.

The aluminum produced at the cathode generally is as pure as the aluminous material forming the anode. It is possible to produce ultrapure aluminum in accordance with the present invention by utilizing a very pure alumina source or to produce a slightly impure aluminum by the direct use of aluminous ore materials such as bauxite or aluminum bearing clays such as kaolin or mixtures of these ores. In general it is possible to obtain purity of aluminum of at least 99.5%.

It is known in the Hall-Heroult cell reaction that the carbon of the anode contributes to the overall reaction of winning aluminum by decreasing the decomposition voltage of $Al_2O_3$. For example the decomposition of $Al_2O_3$ in cryolite on a platinum anode is about 2.2 volts but on a carbon electrode considering about 50 Vol% CO produced and 50% $CO_2$, the decomposition voltage is about 1.2. Approximately, the same decomposition voltage is obtained from $Al_2O_3$ if methane is injected under the platinum anode to produce mainly $CO_2$.

In the instant invention, the use of the composite anode results in a lower decomposition voltage than would be obtained if $AlCl_3$ were decomposed with the discharge of $Cl_2$ gas on the anode. In any electrochemical reaction if the current voltage curve is extrapolated to 0 current, a number approximating the decomposition voltage is obtained. In an aluminum chloride electrolysis process when a graphite anode is used, a decomposition of 1.8 to 2.0 V can be obtained which is consistent with values reported in the literature and the theoretical value calculated from thermodynamics.

It was found that the decomposition voltage of the instant invention varies slightly with electrolyte composition. With pure $NaAlCl_4$ the decomposition voltage is the lowest but as the $AlCl_3$ component of the electrolyte decreased, the decomposition voltage tended to increase slightly. The lowest decomposition voltage obtained was 0.5 volts and the highest 1.5 volts. The average value was 1.2 volts. Utilizing the most prevalent average value of 1.2 decomposition voltage, it can be observed that in the present invention the decomposition voltage is less by 0.6 volts than that for $AlCl_3$ when chlorine is discharged and the presently obtained value approximates that of $Al_2O_3$ and carbon which suggests that the same overall reaction mechanism occurs both in the Hall-Heroult cell and in the present invention. This lower decomposition voltage results in a considerable energy saving for the electrolytic production of aluminum not only compared to classical aluminum chloride systems where chlorine is discharged at the anode but also when considering the additional energy necessary to produce $AlCl_3$ from $Al_2O_3$, carbon and chlorine.

The process conditions for the electrolytic production of aluminum have not been found to be critical with respect to the voltage applied or the current density. The temperature of the bath may vary considerably and is simply that necessary to maintain the bath molten which, depending upon the composition of the halide salts present may be achieved within the temperature range of 150° to 1000° C. but generally may be in the range of between the melting point of aluminum and the boiling point of the cell components, preferably 10° to 400° C. and most preferably 10° to 150° C. above the melting point of the aluminum. The pressure conditions within the enclosed cell are not critical particularly inasmuch as there is no chlorine gas escaping as in prior art aluminum chloride salt processes. While CO or $CO_2$ or both may be generated from the present process, these gases are not as corrosive as chlorine. The pressure conditions, not being important, may range from atmospheric to 10 or more psig.

b. All Fluoride Containing Bath

The Hall cell operates chemically based upon the fact that alumina will dissolve in the cryolite-fluoride salt bath at a temperature of 950°-1000° C. Bayer alumina is soluble in the cryolite containing bath at a minimum temperature of at least 900° C. or above. Any fluoride containing bath at a temperature below about 900° C. will not readily solubilize ordinary processed Bayer alumina and, therefore, alumina, as the source of aluminum, cannot enter the reduction reaction nor is it possible for aluminum to be deposited at the cathode. Without this general solubility of alumina in the fluoride salt bath, it is not feasible to electrowin aluminum.

It has been discovered, as one aspect of the present invention, that in all fluoride containing baths the temperatures may be in the range of between the melting point of aluminum and the boiling point of the cell components, preferably 10°-400° C. and most preferably 10° to 150° C. above the melting point of the aluminum. To electrowin aluminum from its corresponding oxide or other oxygen containing compound the range of bath temperatures generally would be about 670°-800° C. and preferably 700°-750° C.

The important aspect of this discovery which differentiates it from the conventional procedures of the Hall-Heroult cell is that the composite anode containing the mixture of aluminum oxide and reducing agent effects a transformation of the aluminum oxide and produces ionic aluminum in the low temperature fluoride bath. The overall reaction, however, is believed to be essentially the same as the Hall cell reaction as previously stated. The aluminum is produced in liquid form on the liquid metal pool serving as the cathode. It is presumed that a reaction occurs at the anode surface in a unique manner that results in the reaction of aluminum oxide to produce aluminum ions similar to the mechanism that occurs in the Hall cell even though the temperature is only slightly above the melting point of aluminum.

The importance of utilizing the composite anode in the present invention should be quite clear because under the same conditions as that of the present invention but using a carbon or other non-consumable anode, the addition of aluminum oxide to the bath will not result in either the dissolution of the aluminum oxide or the electrodeposition of the aluminum. A notable feature of the present invention is that, utilizing the composite anode in a low temperature from 670°-800° with an all fluoride electrolytic bath, the Hall cell can be operated in a manner such as FIG. 4 without the closed top required in the operation of the chloride bath as shown in FIG. 1. The bath composition, current densities and other process parameters are not critical to the operation of the chloride bath or fluoride bath containing cell.

The Anode

The principal support for the achievement of the benefits of the present invention lies in the use of a unique composite anode composed of an oxygen containing aluminous compound, usually aluminum oxide, and a reducing agent.

The anode provides the sole source of aluminum ions for electrolytic reduction to aluminum at the cathode as well as, with a carbon reducing agent, the means to conduct electrical current through the dielectric aluminum oxide to the reaction site for the aluminum oxide in contact with and immersed in the electrolyte. The anode also preferably provides at least in part a necessary source of a reducing agent that enables the aluminum oxide to react in the anodic environment to produce the aluminum for deposition at the cathode as aluminum metal.

The reducing agent is preferably, at least in part, intermixed with the aluminum oxide to provide intimate contact between the reducing agent and the aluminum oxide. The reducing agent, if properly selected, to be conductive may when intermixed with the aluminum oxide also fulfill the function of a conductor of electrical current to the reaction site for the aluminum oxide. Following the reaction of each particle of aluminum oxide at a particular site in contact with the electrolyte and having present an electrical current, another particle at the same site now is uncovered and can react. This pattern occurs throughout the surface of the anode and continues until there is no more aluminum oxide to react. If the reducing agent is not conductive and is not intermixed with the aluminum oxide, the electrical conductor function must be otherwise achieved by conductor rods to maintain the aluminum oxide anodic at the reaction site.

In an aluminum chloride salt bath, the anode has the function to provide a reducing agent that aids in the theorized reaction of the aluminous source with the chloride or oxygen or both to maintain a constant concentration of aluminum chloride. The maintenance of a constant concentration of aluminum chloride is an important part of the chloride cycle of the present invention because it eliminates the necessity for any external replenishment of the aluminum chloride being electrolyzed or the discharge of chlorine on the anode.

In the all fluoride bath process, the anode of this invention as in the case of the chlorine cycle provides the aluminum oxide that reacts in the fluoride bath to form aluminum ions at a uniquely low temperature in the 670°–800° C. range. The cell may also be open as in FIGS. 4, 5 or 7.

The source of the aluminum is alumina, $Al_2O_3$, but also it could be any aluminum oxide bearing material such as bauxite or a clay such as kaolin or other material which would react at the anode to produce aluminum ions to be reduced to the molten metal at the cathode as in the fluoride or chloride cycle processes.

When the intermixture forms the anode, the proportion is in an amount that ranges from at least 1.5 up, with acceptable upper limits of 7.5, 20.0 or even 50.0 or more parts by weight of aluminum oxide in the aluminous material per part of the weight of the reducing agent. Preferably, for the purposes of the present invention, the amount of aluminum oxide in the aluminous material intermixture may be 2.0 to 6.5 and most preferably 2.5–6.0 parts of weight aluminum oxide per part reducing agent.

The reducing agent that may be used in accordance with the present invention is not limited to any particular material, but could be any of those materials known to be effective to react with the aluminum oxide. The reaction in the fluoride and chloride baths is not clearly defined but it may be that the reducing agent reacts with the $Al_2O_3$ to produce aluminum ions that eventually deposit on the cathode and $CO_2$ at the anode. The reaction mechanism may be the same in all chloride, all fluoride or mixed chloride/fluoride salt electrolytes.

Among the reducing agents that are particularly useful for alumina and other oxides are carbon or a reducing carbon compound used in the intermixture. Carbon is particularly preferred because it characteristically has the dual capability of carrying current to the reaction site of the aluminum oxide as well as maintaining a reducing function and giving of a gaseous product at the anode.

The source of carbon in the intermixture can be any organic material particularly those having a fossil origin such as tar, pitch, coal and coal products, reducing gases, for example carbon monoxide, and may also include natural and synthetic resinous materials such as the waxes, gums, phenolics, epoxies, vinyls, etc. and the like which may if desired be coked even while in the presence of the aluminous material. Coking of the carbon source intermixed with the aluminum oxide compound can be accomplished by known art techniques such as those used in prebaked anodes that are utilized in the Hall-Heroult cell. This is accomplished by casting, molding, extruding, etc., a composite anode such as $Al_2O_3$-pitch in the desired ratio of, for example 6.5 parts aluminum oxide to one part carbon in the coked condition, and slowly heating the formed anode in a nonoxidizing atmosphere to a coking temperature of 700° to 1200° C. After coking, the composite anode is then ready for use.

It is also, for instance, contemplated within the scope of the present invention to produce carbon as a reducing agent in the intermixture with aluminum oxide by coking the carbon source in the molten electrolytic bath both prior to and during electrolysis. Bath temperatures typically in the range of 670° to 850° C. are adequate to coke the carbon source to produce the carbon necessary. The time to achieve such coking is not critical but it may require several minutes to several hours depending upon the temperature of the molten bath and the mass of the mixture of aluminous source and the reducing carbon source.

Continuous coking is possible using the attachment clamp of FIG. 4 by introducing one anode on top of the last and as consumption occurs the anode is continuously lowered until one is completely consumed and the next takes its place, and so on. The anode may be fed continuously to the cell in the green state as in the case of a traditional Soderberg electrode. The green composite anode material is gradually coked from the heat of the cell such that the end of the anode in the salt is always fully coked to the operating temperature of the cell. Coking in the Soderberg fashion in the cell at 670°–850° produces a lower conductivity anode compared to composite anodes prebaked at much higher temperatures.

The entire source of the reducing agent, as previously stated, optionally need not be intermixed with the aluminum oxide source to form the anode. It has been found, for instance, that the only requirements for the reducing agent are that it be in contact with the anodic aluminum oxide and present in sufficient amounts to produce aluminum metal at the cathode. It is manifest however that electric current must be transmitted to the reaction site to enable the reaction to proceed.

In the case of alumina as the aluminous material, the use of hydrated or calcined alumina may be used. Anodes formed from hydrated alumina can show improved conductivity compared to calcined alumina but hydrated alumina, $Al_2O_3 \times 3H_2O$ or $Al(OH)_3$ has the tendency to crack during prebaked type coking and when placed in the hot bath, due to the water driven off during the coking operation. In an aluminum chloride containing salt utilizing an in bath coking of the hydrated alumina, the water driven off could undesirably hydrolyze the $AlCl_3$.

Any cracking or breaking of the anode due to the expelled moisture causes no difficulty provided the membrane as shown in FIG. 5 surrounds the anode. Any particles of the anode that drop off will be contained in the membrane for continual reaction. The anode may also be any proportion of hydrated and calcined oxide to minimize the cracking. The maximum amount of hydrated oxide that can be used affects an energy saving in calcining.

The size and surface area of the particles making up the anode containing the aluminum oxide have not shown any sensitivity regarding anode reaction rate. This characteristic of the present invention is in contrast to prior art experience in the reaction of $Al_2O_3$ and carbon with chlorine as a gas-solid reaction in a furnace. In the past it has been found that the reaction temperature and rate are highly sensitive to the particle size and particular surface areas.

It is generally desired in the prior art to utilize alumina with a surface area in the range of 10 to 125 $m^2/g$ in the $AlCl_3$ reaction. However, in the present invention, no sensitivity was detected with regard to reaction rate of the anode based upon particle size or surface area. That is, $Al_2O_3$ with a surface area of 0.5 $m^2/g$ or less apparently reacted as readily as $Al_2O_3$ with a surface area of 100 $m^2/g$. These results are based upon experiments run with anodes containing alumina having particles with differing surface area and sizes. Anode current densities ranging from 2 to 40 amps/$in^2$ were run in cells with the exhaust line connected to a starch-iodine indicator for chlorine detection. No chlorine gas was detected regardless of the current density or the surface area of the alumina. This suggests that if any chlorine is produced at the anode it all reacts to reform aluminum chloride or that only aluminum ions form at the anode from the $Al_2O_3$ while the oxygen from the $Al_2O_3$ combines with the carbon producing $CO_2$. It is believed that to produce chlorine at the anode it would be necessary to raise the potential so high as to overcome the decomposition potential of the $AlCl_3$ but even then the produced chlorine would probably react with the $Al_2O_3$ and carbon to produce more $AlCl_3$ rather than evolve chlorine at the anode.

Figure 2:
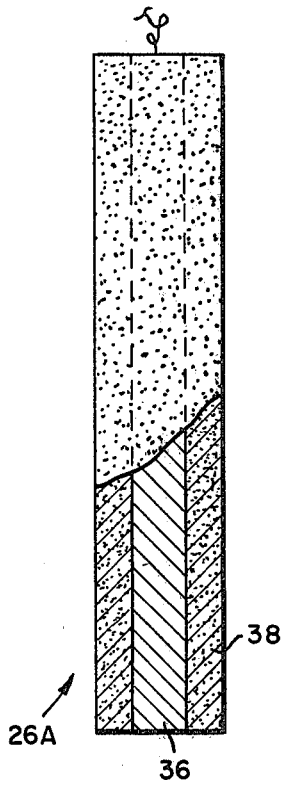
FIG. 2 is a schematic showing partly broken away of an electrode being used as an anode and having coated thereon the mixture of aluminous material and reducing agent.

Anodes for use in electrolysis cells may be produced in a variety of forms and by a variety of fabrication processes. A mixture of aluminum oxide material and the reducing agent may form the anode in any convenient manner. For instance, a mixture may be bonded to a typical electrode to form a coating surrounding all or one side of the electrode as shown in FIG. 2 of the drawings. It is also contemplated that the anode material may form the anode by being molded or formed into a suitable shape to which is attached one end of the electrode rod or pin in the manner shown in FIG. 3 of the drawings. It is also possible to meet the requirements of the present invention to form the anode in the manner other than having any physical bonding directly to the electrode. It is desirable, however, that the aluminous material be in intimate physical contact with the carbonaceous material or other reducer. The latter concept may be brought into being if the mixtures of the aluminous material and reducer are in the form of a homogenous mixture of powders, small pellets of the mixed powders, or larger composite briquettes of such mixed materials that may have been formed by molding or extrusion into various sizes from 0.001 inch to 1 inch or more. Uniformity of the distribution of the carbon and aluminum oxide has been found to be desirable to attain maximum anode efficiency during its dissolution or reaction under electrolysis.

To hold the aluminous material and the reducing agent forming the anodic materials in the region of the electrode and thus in combination forming the anode, a container in the form of a porous membrane M may be utilized.

For successful commercial use, the anode should be as conductive as possible. Since the anode of the present invention is not solid or pure carbon as is traditionally used in the Hall cell, it will be less conductive because of the presence of the aluminous compound. If the anode were permitted to become as resistive as the salt electrolyte then the heat balance can be affected due to overheating that can occur as a result of passing the same current through the more resistive anode. For instance, when using a solid composite anode such as shown in FIG. 3 in the cell of FIG. 1, it is necessary for the electric current to travel through the anode from top to bottom, with power losses translated to heating of the bath. It is therefore desirable to construct an anode to have as high a conductivity as possible. Obviously, the more conductive the anode material, the lower the power consumption for winning metal but in any event the conductivity of the anode should be greater than the conductivity of the salt for optimum operation. Particularly when it is desired to achieve the goal of maximum production of aluminum with minimum power usage, the resistance of the anode becomes significant.

It has been found that the conductivity of the anode varies considerably depending on the manufacturing process. The parameters which have been found to affect conductivity are the ratio of binder carbon material such as pitch, carbon or coke particles included in the composite anode as the source of the reducing agent and the type of aluminum oxide. The greater the carbon content of the anode, within the previously specified ratio of aluminum oxide to reducing agent, the greater the conductivity. It is possible, for example, when using a ratio in the range of 4/1 to 6/1 aluminum oxide to carbon to construct a solid composite anode that has at least a tenth the conductivity of a standard Hall-Heroult anode.

Figure 2A:
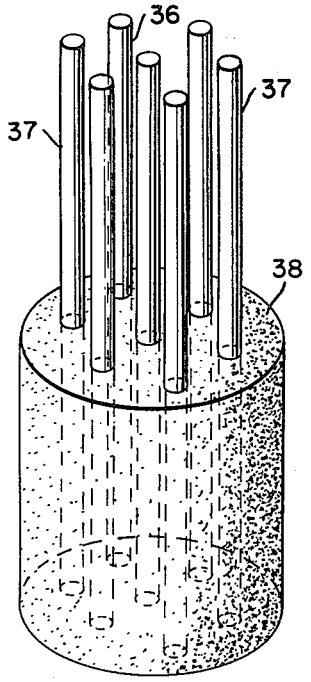
FIG. 2A is a schematic view in perspective of an alternate embodiment of the electrode of FIG. 2 showing a plurality of conductor cores within a matrix of the aluminous material and reducing agent.
Figure 2B:
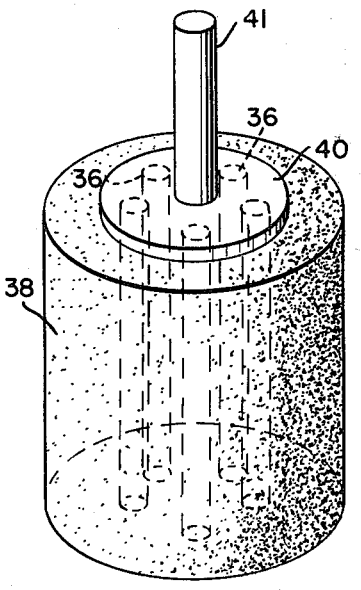
FIG. 2B is a schematic perspective view of a variation of the electrode illustrated in FIG. 2A.

In order to reduce the power loss through the composite anode several alternatives are also shown in FIGS. 2, 2A and 2B.

To achieve higher conductivity and reduce power loss through the composite prebaked anode another embodiment utilizes one or more conductive cores 36 or 37 positioned in the anode as shown in FIGS. 2, 2A and 2B.

The composite anode 26A shown in FIG. 2 has a conductive central core 36 that can be carbon or graphite molded into the composite anode or the composite anode material composition 38 molded or coated into a preformed conductive core shape. The central core 36 may also be a metal such as the same metal being deposited, for example, aluminum. The exterior of the conductor 36 is coated on one side for bipolar use or surrounded on both sides for monopolar use by a matrix 38 of composite anode material comprising the mixture of aluminum oxides and reducing agent as previously described. When coated on a single side a bipolar operation is anticipated. The term "oxides" should be interpreted to include the silicates which often are a combination of the metal oxide and silicon oxide or any other oxygen containing compound of the aluminum to be deposited.

For large size anodes another alternate embodiment is shown in FIG. 2A and 2B. To improve conductivity, primary grade purity aluminum rods 36 and 37 are preferred to be used as electrical conduction buses in a matrix of the composite anode composition 38 that may be of the prebaked or Soderberg type. Since primary grade aluminum is used to form the conductor rods, it will melt as the anode is consumed and join the cathode metal for a continuous cycle. The rods are spaced such that the voltage drop is minimized relative to the conductivity of the composite anode. In FIG. 2B the conductor rods 36 are shown to be connected to a plate 40 supported by a central conductor 41.

The number and size of the conductors 36 and 37 are selected based on anode size, current density of the anode, cell size, operating temperature and heat transfer such that the aluminum conductors 36 and 37 melt at the same rate that the matrix 38 of the anode is consumed. The unique advantage of the anode embodiments shown in FIGS. 2A and 2B is the avoidance of large voltage drops in the relatively highly resistive anode so as to permit the process to be operated at substantially reduced power consumption. The size of the aluminum rods may fall within the diameter range of 0.0625 to 3.0 inches preferably 0.125 to 2.0 inches most preferably 0.25 to 1.0 inch.

To achieve desirable conductivity in the anode the spacing between the outer surface of the composite anode 38 and the surface of any aluminum rod as in FIG. 2, 2A or 2B and mutual spacing between the outer surfaces of these aluminum rods in FIGS. 2A and 2B is not critical and may range from 0.125 to 24 inches, preferably 1.0 to 6.0 inches and most preferably 1.5 to 4.0 inches. As an example, if the conductivity of the composite anode is approximately 0.1 of a standard prebaked Hall cell anode then aluminum rod spacing of approximately 3.0 inches will result in an acceptable voltage drop.

Since the operating temperature of the cell is usually in the 700°–750° C. range the aluminum rods can be sized such that they will melt approximately at the same rate as the anode is consumed and will thus conduct power to the bottom of the anode. If the diameter of the aluminum rod is too large, it will not melt and salt will freeze over its surface which results in the anode being consumed leaving an aluminum stub that will short to the cathode as the anode is advanced. If the rod diameter is too small it will melt back too far into the anode which results in too large a voltage drop due to the longer conductivity path. It is desirable that the aluminum rods melt back into the anode to a slight degree rather than remaining flush with the bottom surface of the anode. This is so that anodic oxidation of the aluminum rods will be minimized. Desirable melt back distance is based upon that which provides the minimum voltage drop coupled with the minimum anodic oxidation of the aluminum rods. Should the rods remain flush with the bottom surface of the anode, there would be a tendency for aluminum ions to pass into the bath from the rods (as in a refining operation) as well as from the composite anode material, thus lowering the cell's Faradaic efficiency. Heat can be balanced such that the conductance from the bath up through the anode and power generated through the conductors is balanced to achieve the desired amount of melting of the conductor aluminum rods.

FIG. 3 discloses another alternative embodiment of the composition of an anode electrode as shown at 26B. In the embodiment electrode 26B is composed of a composite 38 which may be the same as the coating 38 in FIG. 2 but is formed into a suitable shape for use as an electrode. This form of the electrode may be molded about a stub or pin electrode 42 which extends out from the upper end of the body of the electrode 26B for connection of the usual electrical circuit. Alternatively electrode 26B is molded and then stub 42 is inserted by known art techniques such as utilized with prebaked Hall cell anodes.

The embodiments of FIGS. 12 and 13 illustrate a variation of conducting electrical energy to the working surface of the anode. As shown blocks 94 of the composite anode A are laminated with sheets of aluminum metal 108. These sheets act precisely as the aluminum rods in FIGS. 2A and 2B. The shape and number of laminae are not critical. The blocks may lie in continuous form and fed into the cell through clamp 47 as in FIG. 4 to which along with the aluminum sheets 108, the electrical connection is made.

The number, spacing and thickness of the aluminum sheets 108 are determined by the same factors as described with respect to the conductors 36 and 37. Generally the aluminum sheet thickness will range from 0.001 to 0.5 inches thick and preferably 0.010 to 0.375 inches and most preferably 0.010 to 0.25 inches thick. The aluminum sheets must be of sufficient thickness to conduct the necessary current to avoid major voltage drop and also melt into the cathode pool as the anode is consumed. The spacing between the aluminum sheets 108 is such as to avoid excessive voltage drop through the composite block as set forth with respect to conductors 36 and 37. Generally the spacing will range from 0.125 to 24.0 inches, preferably from 1.0 to 6.0 inches and most preferably 1.5–4.0 inches.

The Membrane

The membrane as shown in FIG. 5 of the drawings is designed to have a tripartite function or capability.

First, the membrane acts as a separator or quiescent barrier between the molten cathodic metal phase and the source of anode material to be electrolyzed. With the use of the membrane of this invention, the spacing can be reduced substantially to achieve significant increases in conductivity and efficiency without any turbulent effects that could otherwise produce a reduction in the efficiency or quality of the aluminum product.

Second, in the present invention, the membrane physically restrains materials of the composite anode that, for instance, may include the aluminous raw material and the reducing agent. This restraint maintains these materials close to the electrode to form an anode for production of aluminum ions in the most efficient manner. The membrane also prevents mixing of the raw materials with the molten aluminum at the cell bottom. Should a hydrated metal oxide, such as the hydrated alumina, be used as one of the anodic materials, the membrane holds any of the pieces of the anode that may crack off due to the evolution of moisture from the alumina during bath coking. These pieces continue to be a source of aluminum through the reduction reaction as long as they are within the anode circuit within the membrane.

Third, the membrane permits the free passage of ionic substances and dissolved solids in the electrolyte but will not pass and will substantially reject molten aluminum and undissolved solid materials that constitute the usual impurities present in the aluminous source and prevent the contamination of the cathodic deposition.

The external shape of the membrane is not important and may be in the form of a cylinder, prism, etc., or portion thereof. For instance, the membrane may have a three or four-sided shape with a bottom and thus form an enclosed container. This container is so designed to hold the anodic raw materials for reaction in the salt bath.

Due to the corrosive nature of the molten salt bath, the selection of the materials to form the membrane is important to the life of the cell and the success of the process. If the electrolyte to be used is an all chloride bath, the choices for the membrane are somewhat greater due to the reduced corrosive character of such a bath as compared to a bath containing fluorides. Baths containing some fluorides are preferred, however, because of their lower volatility. The all fluoride bath possesses other advantages as set forth above. Materials suitable for use in a fluoride bath would of course be useful in the less corrosive chloride bath.

The refractory hard metals forming the membrane of the prevent invention may be made into the form of a cloth, mat, felt, foam, porous sintered solid base or simply a coating on such a base, all of which are known in the art for other purposes. The membrane must also meet particular standards of through passage porosity and connected pore size.

These two characteristics may be defined as follows:

through passage porosity—the percentage of the total volume of the membrane that is made up of passages that pass through from one side of the membrane to the other;

connected pore size—the smallest diameter of a passage through the membrane.

The through passage porosity varies with the nature of the membrane material, the temperature of the molten bath and the salt composition but the common characteristic of useful membranes is that the porosity must be sufficient to pass all the metal ions such as aluminum and all the electrolyte salts without passing the undissolved impurities. It has been found that the greater the porosity, the greater is the current flow and, therefore, the greater the electrical efficiency of the cell. The porosity may vary from 1% to 97% or more, but generally is in the range of 30% to 70%. The preferred porosity to achieve the greatest efficiency is in the 90% to 97% range. A vitreous carbon foam, for instance, is capable of yielding such a high porosity and retain sufficient mechanical strength.

The connected pore size must be small enough to reject the solid impurities that have not been dissolved but large enough to pass the ionic and dissolved particles. Generally, the acceptable pore size is between one micron and one cm.

The thickness of the membrane material is a function of its porosity, pore size and ability to retain undissolved impure solids and molten metal. Obviously the thicker the membrane, the greater the electrical resistance. It is therefore desirable to use as thin a membrane as is practical consistent with the porosity and pore size standards as well as the mechanical strength of the membrane in position in the cell. The preferable thickness is 0.125 to 0.5 inch but may be as thick as 2.0 inches or more.

Typical membrane materials that have been found useful include but are not limited to vitreous carbon foam, carbon or graphite in the form of a porous solid, felt or cloth, aluminum nitride, silicon nitride, silicon carbide, silicon oxynitride, boron nitride and titanium nitride as a porous solid, as a cloth or as a coating on the surface of a vitreous carbon foam or porous graphite. Aluminum nitride appears to be the most desirable material. It has been found that aluminum nitride can conveniently be formed in a porous structure by first making a porous alumina structure then impregnating with carbon followed by heating to 1750° C. in a nitrogen atmosphere to convert the alumina to aluminum nitride. Such a procedure results in a strong porous structure that is chemically compatible with the corrosive salt environment and the molten aluminum.

The Molten Bath Composition

The electrolytic bath of the present invention can vary considerably in comparison to the typical Hall cell salt composition. In the present invention the bath composition may include any halide salt, particularly, chloride and fluoride are favored. Any alkali or alkaline earth metal such as particularly sodium, potassium, lithium, calcium, magnesium, barium and the like may be used to form the halide salts. There is no critical composition or range of proportions desired or necessary. It has been observed that no aluminum salt need initially be present in the electrolyte to produce aluminum under electrolysis utilizing the composite anode. For example, a salt electrolyte containing only alkali and/or alkaline earth halides will produce aluminum metal at the cathode utilizing the composite anode and with no "anode effect."

It is generally preferred for the salt bath to initially contain an aluminum halide, although this is not necessary to practice the invention. In the case of the $AlCl_3$ containing baths which may contain only chloride anions or both chloride and fluoride anions, the aluminum chloride concentration may be 2 to 60% but may also be in the range of 1% to 95% by weight $AlCl_3$. The all fluoride bath may include the same fluoride salts as set forth above and may as well contain aluminum fluoride in any proportion desired.

Among the advantages and disadvantages of the various electrolyte types are that the all chloride bath has very low tolerance to oxide contamination, but has very high conductivity and is the least corrosive to refractories and cell components. greatly enhanced. In fluoride containing electrolytes the aluminum deposits as droplets which agglomerate and pool readily, but the corrosivity of the electrolyte to refractories and cell components is greatly increased.

A lithium component of any electrolyte will increase the conductivity but is expensive and increases the cost of the electrolyte. This has to be balanced in any operation as to the electrolyte cost, conductivity of the electrolyte and the resultant power consumption of producing the aluminum.

The preferred electrolyte is a balance of economics of the salt components, conductivity, corrosiveness to refractories and cell components, tolerance to oxide contamination and agglomeration of the deposited aluminum into a pool for easy harvesting.

EXAMPLES

Example 1

In FIG. 1, the anodes are graphite plates and the cathode electrode is a titanium diboride plate. The anodes were prepared with a coating 38 as shown in FIG. 2 which consisted of Bayer Process purified $Al_2O_3$ calcined to 1000° C. and mixed in a weight proportion of five parts $Al_2O_3$ to one part carbon in the coked stage. The carbon was obtained by mixing the $Al_2O_3$ with a phenolic resin and gradually heating to 1000° C. in an inert atmosphere for coking the phenolic resin to carbon. The electrode coating was prepared by mixing the $Al_2O_3$ and phenolic, troweling or otherwise applying the mixture on the electrode, and heating to coking temperature.

The electrolyte consisted of an equimolar mixture of sodium chloride and aluminum chloride forming the double salt $NaAlCl_4$ at about 150° C. The temperature of the cell was raised to 700° C. and electrolysis of the $Al_2O_3$ conducted for several hours which produced a layer of molten aluminum on the bottom of the cell. Examination of the anode revealed that the coating had dissolved and aluminum was deposited at the cathode.

This deposition of aluminum was equivalent to the aluminum content of the $Al_2O_3$ dissolved at the anode. The overall controlling reaction is believed to be the ionization of the $Al_2O_3$ in the anode with the carbon reacting to form primarily $CO_2$. During the electrolysis there was no evidence of any chlorine gas being liberated at the anodes and in the exit tube. The exit gas was analyzed and determined to be primarily $CO_2$.

Example 2

The electrolyte salt composition consisted of 63% NaCl, 17% LiCl, 10% LiF, 10% $AlCl_3$ and the electrode coating of FIG. 2 was prepared from standard bauxite $Al_2O_3$ and a petroleum tar pitch which was coked to produce an $Al_2O_3$ to carbon (as coked) ratio of 5.7 to 1. The electrolysis was conducted in the FIG. 1 cell at a temperature of 750° C. The spacing between anode and cathode was ½ inch which produced an electrode current density of 15 amps/in$^2$ at an imposed voltage of 2.5 volts. There was no chlorine gas detected as being released from the anode which is indicative of the $Al_2O_3$ in the bauxite reacting so as to prevent any free chlorine from being formed in the anodic cycle. Aluminum was deposited which settled to the bottom of the cell. The harvested aluminum was produced at a Faradaic efficiency of 92% with an energy consumption of 3.67 kwh/lb.

Example 3

The electrolyte salt composition consisted of 10% NaCl, 50% $CaCl_2$, 20% $CaF_2$, 20% $AlCl_3$. The electrode coating of FIG. 2 was prepared as in Example 2 but only on one side of the electrode. The electrical connections were made such that the anode adjacent to the exit tube was connected to the positive terminal and the negative terminal to the electrode most remote to the exit tube. The coated sides of the electrodes 25 and 26 each faced away from the exit tube and toward the cathode. Electrode 24, the cathode, was not coated. This results in electrode 25 not being physically connected to the direct current power supply. That electrode then becomes bipolar. The side coated with the $Al_2O_3$-C mixture is thus positively charged. The side of bipolar electrode 25 nearest the exit tube becomes negatively charged upon which aluminum is deposited and sinks into the molten pool. Aluminum also deposits on the negatively charged electrode 24 and sinks into the molten pool. The temperature of the cell operation was 800° C. and the imposed voltage was 3 volts with respect to each electrode or a total of 6 volts across the terminals. This imposed voltage with an electrode spacing of ¾ inch resulted in an electrode current density of 12 amps/in$^2$.

Example 4

The anode electrodes were composed of titanium diboride rods and the cathode electrode was also titanium diboride. The anodes were coated with bauxite as in FIG. 2 which has been calcined at 600° C., mixed with phenolic resin, and coked at 800° C. The ratio of aluminum oxide in the bauxite to carbon after coking was 6 to 1. The electrolyte salt composition was 20% NaCl, 30% $CaCl_2$, 10% $CaF_2$, 4% NaF, 36% $AlCl_3$ and was operated at 750° C. at an electrode density of 15 amps/in$^2$. This resulted in 4 volts at an electrode spacing approximately ¾ inch. No chlorine gas was observed in the discharge exit port which shows that if any chlorine was generated at the anode it reacted with the bauxite to reform metal chlorides which were then deposited as metal at the cathode. The composition of the aluminum deposited in the molten pool was 97% pure containing 0.5% Si, 1.5% Fe and 0.9% Ti with minor other constituents.

Example 5

The electrolyte salt composition consisted of 65% $CaCl_2$, 20% $CaF_2$, 5% NaF, and 10% $AlCl_3$. The anode electrodes were as shown in FIG. 3 made an aluminum oxide to carbon ratio of 5.5 to 1 using a copper bus pin. The aluminum oxide was commercial grade Alcoa A-1 and the carbon was obtained from a mixture of phenolic and pitch which was coked to 1100° C. Electrolysis in a cell as shown in FIG. 1 produced aluminum metal that settled into the pool at the bottom of the cell. No chlorine gas was detected in the exit tube. The aluminum produced had a purity of 99.9%.

Example 6

The elctrolyte salt composition consisted of 30% NaCl, 8% LiCl, 27% $CaCl_2$, 20% $CaF_2$, 10% LiF and 5% $AlCl_3$. The anode electrodes were graphite coated with a clay mineral kaolin and carbon as in FIG. 2 to yield a ratio of 5.6 $Al_2O_3$ in the clay to 1 carbon after coking. Electrolysis yielded aluminum without any chlorine gas being detected in the exit tube while the anode coating dissolved as a result of electrolysis.

Example 7

The electrolyte of Example 4 was used and the anode electrode of FIG. 2 was prepared by mixing bauxite and a phenolic resin in a consistency to approximate that of a viscous gel and which would yield a ratio of contained aluminum oxide to carbon of 5.5 to 1 upon coking. The bauxite-phenolic was troweled onto the graphite for use as an anode and dried to 150° C. which produced a hard coating but not one fully cured. The electrode was then gradually lowered into the salt electrolyte which was at a temperature of 780° C. After a five minute period to allow volatiles from the phenolic to escape and coking to occur, electrolysis was conducted which produced aluminum and anode dissolution without the evolution of any chlorine gas in the exit tube.

Example 8

The cell in FIG. 5 utilized a porous membrane of aluminum nitride material 3/16 inch thick having 50% porosity with a pore size in the range of 12 to 24 microns. The aluminum nitride was obtained by impregnating an alumina porous body with carbon and then heating to 1750° C. in a nitrogen atmosphere. The anode conductor was a graphite rod and the anode aluminous material was a Bayer $Al_2O_3$ and carbon mixed powder in a ratio of 6 to 1. The electrolyte salt composition was 20% NaCl, 25% LiCl, 30% LiF, 25% $AlCl_3$ and electrolysis was conducted at 720° C. The spacing between the membrane and the aluminum pool was approximately ½ inch and electrolysis was run at an anode current density of 10 amps/in$^2$. This resulted in a voltage of 2.8. The aluminum was produced at an efficiency of 92% and had a purity of 99.5%.

Example 9

A salt composition consisting of 12% NaF, 25% LiF, 28% NaCl, 15% LiCl, 10% $AlF_3$ and 10% $AlCl_3$ was melted into a cell with straight side walls. A 2" thick aluminum pad was melted on the bottom of the cell and the operation temperature was adjusted to 700° C. Utilizing an anode as shown in FIG. 2A a spacing between the bottom of the anode and the aluminum pad of $1\frac{3}{4}$ inches was set. At an anode current density of 6 amps/in$^2$ the cell potential was 3.5 volts.

After 8 hours electrolysis, the anode was removed from the cell and placed in a cell with 45° side walls such as shown in FIG. 7. After a few hours electrolysis the anode had eroded such that its sides were parallel to the cathode side walls. The anode immersion depth in the salt was three inches. Utilizing the same total current as in the straight sided cell, the potential was 2.45 volts. This lowered potential due to side anode erosion at 90% current efficiency and at a constant production rate reduces the power consumption from 5.25 kwh/lb to 3.68 kwh/lb which is a reduction of 1.57 kwh/lb.

Example 10

A salt composition consisting of 20% NaCl, 25% LiCl, 25% LiF, 10% NaF, 10% $AlF_3$, 10% $AlCl_3$ was melted in a cell with straight side walls. A 2" thick aluminum pad was melted on the bottom of the cell and the operation temperature adjusted to 700° C. Utilizing a composite anode 12 inches long with a copper bus bar fitted into one end in the traditional manner, the anode-cathode spacing was adjusted to $1\frac{3}{4}$ inches. At an anode current density of 6 amps/in$^2$ the cell potential was 5.75 v. after equilibrium had been reached.

An identical anode but with a 45° slope on the end opposite the bus bar was inserted into a cell with 45° side walls such as shown in FIG. 7. Immersion depth of the anode in the salt was three inches. After a few hours electrolysis to assure the angle on the anode was the same as the side walls of the cell the potential required to achieve the same total current as had been used in the straight sided cell was 4.4 v. This lowered potential due to side anode erosion at 90% current efficiency and at constant production rate between the two cell types, reduces the power consumption from 8.63 kwh/lb to 6.6 kwh/lb which is a reduction of 2.03 kwh/lb.

The reduction in power consumption at a constant current between that used in the traditional cell where the bottom of the anode only is eroded and that in a sloped cathode cell is obvious from this example.

Example 11

An anode was made utilizing Alcoa A-1 $Al_2O_3$ mixed with cold tar pitch and phenolic and molded in a closed die with heat applied to harden the phenolic component. The ratio of components was such that after coking the composite anode contained 17% carbon and 83% $Al_2O_3$. The electrolyte consisted of 20% NaCl, 25% LiCl, 30% LiF and 25% NaF and was operated at 700° C. A cell as shown in FIG. 7 was used but no aluminum pad was added. After several hours electrolysis at about 700° C. aluminum collected in the well showing the composite anode will produce aluminum under electrolysis without the initial use of an aluminum salt in the electrolyte. These results suggest the reaction mechanism of the composite anode is to release aluminum ions into the salt electrolyte which are reduced at the cathode and the carbon in the anode reacts to produce $CO_2$.

Example 12

A straight sided cell such as shown in FIG. 5 was utilized, but without the membrane 68 and anode rod 52. Instead a carbon cylinder was mounted just above the salt electrolyte layer into which was inserted a short anode section such as shown in FIG. 2A. On top of the prebaked short anode and around the conductor rods 37 a mixture of $Al_2O_3$, petroleum coke powder and a mixture of tars and pitches were added. The mixtures of $Al_2O_3$, coke powder and tars/pitches were such as to yield 18% carbon and 82% $Al_2O_3$ when coked to the salt electrolyte temperature of 740° C. A salt electrolyte consisting of 10% NaF, 25% LiF, 20% NaCl, 15% LiCl, 20% $AlF_3$ and 10% $AlCl_3$ was utilized. Electrical connection was made to conductor rods 37 with clips in the cool area above the level of Soderberg type anode composition in the carbon cylinder. Electrolysis was conducted at 10 amps/in$^2$ anode current density with a spacing of $1\frac{1}{4}$ inches between the aluminum pool and anode. Electrolysis was continued with additions of $Al_2O_3$-carbon-tar/pitch in the carbon cylinder and continuous feed of the anode which hardened and coked as it entered the salt electrolyte. The aluminum conductor rods melted as the anode was consumed and joined the cathode pool 32 of aluminum.

A similar run was made utilizing a carbon rectangle, rectangular prebaked blocks and aluminum sheet as shown in FIG. 13. The aluminum sheets were 0.060 thick and the prebaked blocks were 2.0 inches thick. Electrical connection was made utilizing rollers on each aluminum sheet. As the anode was advanced additional prebaked blocks were inserted between the aluminum sheets.

We claim:

1. An anode for use in an electrolytic cell for the electrolytic production of aluminum from a molten electrolyte salt bath at a temperature above the melting temperature of aluminum and below the temperature at which aluminum ore will substantially dissolve in the electrolyte in molten form, by an electric current at a cathode, said anode comprising in combination a stable bonded mixture of an oxygen containing compound of aluminum with an electrically conductive reducing agent in an amount sufficient to carry the anodic current into and through said anode to thereby efficiently decompose the stable mixture and release aluminum ions from the compound of aluminum solely by the anodic chemical reaction at the anode as the sole source of aluminum produced at said cathode, the stable physical bond between said compound and reducing agent constituting means confining the compound of aluminum in anodic electrical connection with said conductive means until converted by said chemical reaction at the anode wherein the anode has improved conductivity by means of a conductive member in external contact with the anode intermixture, and wherein the conductive member comprises a movable clamp assembly contacting a surface of the anode at a position near the termination of the anode in the electrolyte.

2. An anode for use in an electrolytic cell for the production of aluminum from a molten electrolyte salt bath at a temperature above the melting temperature of aluminum and below the temperature at which aluminum ore will substantially dissolve in the electrolyte, comprising a particulate mixture of an oxygen compound of aluminum with carbon contained in a membrane porous to liquid electrolyte constituents and held in electrical anodic connection to release aluminum ions from the compound of aluminum solely by the anodic chemical reaction as the sole source of aluminum produced wherein the anode including said membrane comprises a compartment containing a mixture of said compound of aluminum and said reducing agent and is constructed to present bipolar electrode faces.

3. The anode of claim 2 including, said membrane being formed from a material selected from the group consisting of a vitreous carbon foam, graphite or carbon solid, the nitrides of boron, aluminum, silicon (including the oxynitride), titanium, hafnium, zirconium and tantalum; the silicides of molybdenum, tantalum and tungsten; the carbides of hafnium, tantalum, columbium, zirconium, titanium, silicon, boron and tungsten; and the borides of hafnium, tantalum zirconium, columbium, titanium and silicon, and said material having a connected pore size of a diameter sufficiently small to screen out said mixture and sufficiently large to pass said aluminum ions.

4. The anode of claim 2 wherein the particulate mixture comprises a plurality of bodies having the carbon and aluminum compound bonded together.

5. The anode of claim 2 and further including an electrode of higher electrical conductivity than the mixture in contact with said mixture.

6. The anode of claim 5 wherein said bipolar faces are presented by said electrode.

7. The anode of claim 6 wherein said electrode cooperates with said membrane to form said compartment.

8. The anode of claim 7 wherein said electrode is composed of graphite.

9. The anode of claim 7 further including a plurality of spaced apart compartments formed of a membrane and an electrode with each compartment containing said particulate mixture.

10. An anode for use in an electrolyte as the sole source of aluminum in the electrolytic production of aluminum comprising, a mixture of an aluminous material containing aluminum oxide and a reducing agent including carbon in contact with said aluminum oxide, and at least one conductor of higher electrical conductivity than the mixture in contact with said mixture for conducting electric current substantially through said mixture and extending approximately to but recessed from the face of the anode in contact with said electrolyte thereby reducing the length of the current path within the anode with the ratio of the aluminum oxide in said aluminous material to said reducing agent being above 1.5 parts by weight, said mixture comprising at least two adjacent members, and said conductor comprising a metallic sheet positioned between said members to form a laminated structure therewith.

11. An anode for use in an electrolyte as the sole source of aluminum in the electrolytic production of aluminum comprising a mixture of an aluminous material containing aluminum oxide and a reducing agent including carbon in contact with said aluminum oxide, the ratio of the aluminum oxide in said aluminous material to said reducing agent being above 1.5 parts by weight, at least one conductor of higher electrical conductivity than the mixture in contact with said mixture for conducting electric current to said mixture in contact with said electrolyte, said conductor comprising a bipolar electrode structure presenting anode and cathode faces for operation in electrical contact with said electrolyte, the anode face of said electrode structure comprising said mixture of aluminum oxide and said reducing agent with said electrode being covered on one face only with said aluminum oxide and said reducing agent.

12. The anode of claim 11, said electrode being associated with a membrane porous to electrolyte to form a compartment for said mixture.

13. A self-baking anode for use in an electrolyte as the sole source of aluminum in the electrolytic production of aluminum comprising, a mixture of an aluminous material containing aluminum oxide and carbonaceous material of a character and quantity which upon coking provides a reducing agent in a ratio by weight of 1 part carbon to at least 1.5 parts of aluminum oxide, and at least one aluminum conductor in contact with said mixture for conducting electric anode current substantially through said mixture and extending substantially through the anode for contact with the electrolyte, said mixture comprising at least two adjacent members, and said conductor comprising a metallic sheet positioned between said members to form a laminated structure therewith.

14. The anode of claims 10 or 13 wherein said metallic sheet is sized such that it will melt substantially at the same rate as said mixture is consumed.

15. An improved anode to lower anode resistance and reduce energy in that type of process for the electrolysis of aluminum in which all the aluminum ore is introduced into a molten halide salt electrolyte in anodic contact as an anode body having an electrically resistive mixture of aluminum oxide and carbon reducing agent, the anode body presenting an anode-electrolyte interface surface at which the aluminum oxide is converted to aluminum ions in the electrolyte at a temperature between the melting point of aluminum and 850° C., which aluminum ions are converted to molten aluminum at a cathode surface residing in the electrolyte positioned parallel to the anode surface, the cathode surface confronting said anode surface interface, the anode body being fed along a vertical feed axis as the ore is consumed and the produced aluminum being gathered in molten form below the electrolyte, the improvement comprising:

means for overcoming high energy required in the electrolysis of aluminum resulting from the use of the resistive mixture in the anode body by providing a lowered anode voltage drop through the mixture which remains substantially constant as the anode body is axially fed to replenish ore consumed in the electrolytic process, while maintaining a substantially constant anode-cathode spacing through the electrolyte, axially directed low resistance electrical conductor means internally disposed in the anode body and surrounded by the anode mixture to pass axially through the anode body to said anode-electrolyte interface surface for carrying substantially the entire anodic current and thereby significantly lowering anode resistance and for establishing a reduced and substantially constant length current flow path from the low resistance conductor through the resistive mixture to the anode-electrolyte interface surface as the anode mixture is consumed in the electrolysis process and the anode body is fed to replenish the ore, said conductor means comprising at least one aluminum member of a cross-section that will melt and sink into the electrolyte along its axis during the electrolytic production at substantially the same rate at which the mixture is consumed.

16. The anode improvement as defined in claim 15 wherein said conductor means has a substantially constant cross-section along the feed axis to establish said constant length current flow path through the mixture as the anode mixture is consumed.

17. An anode for the electrolytic production of aluminum comprising:

an anodic mixture of an oxygen-containing compound of aluminum and an electrically conductive reducing agent, said anodic mixture including at least a portion thereof adapted to be immersed in an appropriate electrolyte, with at least one active surface of said portion adapted to be positioned in opposed relationship to but spaced from the surface of a cathode for providing an active anode surface at which the metal oxide may be converted to metal ions recoverable as molten metal at the opposing surface of the cathode, conductor means of higher electrical conductivity than said anodic mixture in physical contact with said portion of same mixture, said conductor means being adapted to conduct substantially the entire anodic current to said portion when connected to a source of electrical power, said conductor means extending internally through said portion of said anodic mixture and having an end thereof positioned at least approximately adjacent said one active surface for transmitting anodic current directly from said conductor means to at least the mixture adjacent the end of said conductor means and to said surface thereby providing short, low resistant current paths through the mixture to said surface, said conductor means comprising at least one aluminum member of a cross-section adapted to melt and sink into the electrolyte along its axis during the electrolytic production of aluminum at substantially the same rate at which the mixture is consumed whereby the end of said conductor means relative to said surface remains substantially unchanged as said anodic mixture at the surface is consumed in the electrolytic process.

18. The anode as defined in claims 15 or 17 wherein said conductor means is bonded to the mixture.

19. The anode of claims 15 or 17 wherein said conductor means comprises a plurality of spaced apart aluminum members extending through said mixture.

20. The anode of claims 15 or 17 wherein said conductor means comprises a plurality of spaced apart aluminum members with the spacing between adjacent aluminum members in the range of 1 to 6 inches.

21. The anode of claims 15 or 17 wherein said conductor means comprises a plurality of spaced apart aluminum members extending through said mixture with each of said spaced apart aluminum members having a cross-section such that each said member will melt at substantially the same rate as said mixture is consumed, and the spacing between adjacent aluminum members being in the range of 1 to 6 inches.

22. The anode of claims 15 or 17 wherein the plane of said surface is inclined relative to the axis of said conductor means.

23. The anode of claim 17 wherein said end of said conductor means is recessed from said surface.

* * * * *